US008948421B2

(12) United States Patent
Akino

(10) Patent No.: US 8,948,421 B2
(45) Date of Patent: Feb. 3, 2015

(54) RIBBON MICROPHONE CIRCUIT

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 575 days.

(21) Appl. No.: 13/295,346

(22) Filed: Nov. 14, 2011

(65) Prior Publication Data

US 2012/0121110 A1 May 17, 2012

(30) Foreign Application Priority Data

Nov. 15, 2010 (JP) ..... 2010-254573

(51) Int. Cl.

| | |
|---|---|
| ***H04R 25/00*** | (2006.01) |
| ***H04R 9/08*** | (2006.01) |
| *H04R 1/00* | (2006.01) |
| *H04R 9/04* | (2006.01) |

(52) U.S. Cl.

CPC . *H04R 9/08* (2013.01); *H04R 9/048* (2013.01)
USPC ..... 381/176; 381/399

(58) Field of Classification Search

CPC ..... H04R 1/025; H04R 1/06; H04R 1/08; H04R 5/02; H04R 5/023; H04R 7/00; H04R 7/06; H04R 7/12; H04R 7/122; H04R 7/14; H04R 9/08; H04R 9/048; H04R 17/00; H04R 31/006; H04R 2499/13; B60R 11/0217; B06B 1/0622
USPC ..... 381/176, 399, 423, 425, 431; 181/164; 367/140, 170, 181
See application file for complete search history.

(56) References Cited

FOREIGN PATENT DOCUMENTS

JP 2007-312260 11/2007

*Primary Examiner* — Brian Ensey
(74) *Attorney, Agent, or Firm* — Whitham Curtis Christofferson & Cook, PC

(57) ABSTRACT

A ribbon microphone circuit includes a ribbon microphone unit; a step-up transformer; buffer amplifier circuits connected to a secondary winding of the step-up transformer; an external power supply circuit as a power source for driving the buffer amplifier circuits; and a switch circuit including photo-relays having lights that are turned on while the external power source is being supplied and having contacts operating depending on states of the respective lights, wherein signals output from the ribbon microphone unit are sent through the buffer amplifier circuits while the external power source is being supplied, and sent without passing through the buffer amplifier circuits while the external power source is being not supplied.

7 Claims, 2 Drawing Sheets

RIBBON MICROPHONE CIRCUIT

BACKGROUND OF THE INVENTION

1. Field of the Invention

The present invention relates to a ribbon microphone circuit including an automatic switching system on the circuit configuration.

2. Related Background Art

A ribbon microphone, a type of dynamic microphone, can produce output without power sources. Since the output level from the ribbon microphone unit is low, a step-up transformer is typically connected to the output terminals of the unit. The ribbon microphone unit is connected to a primary winding of the transformer, and output terminals are provided across a secondary winding thereof. The ribbon microphone unit can output signals at a practical level.

The step-up transformer boosts the output level of the ribbon microphone unit by N times, where N represents a winding ratio of the step-up transformer (1/N=the number of primary winding/the number of secondary winding). That is, the output level increases with an increase in the winding ratio N. The step-up transformer, however, causes an increase in output impedance of the ribbon microphone unit. The output impedance of the ribbon microphone unit increases in proportion to the square ($N^2$) of the winding ratio of the step-up transformer. This may result in large output impedance that causes external noise to be easily mixed.

In a ribbon microphone unit with an output impedance of 600Ω and an output level of −52 dB/Pa, for example, if a winding ratio of the step-up transformer is increased so that the output level is increased to −42 dB/Pa, the output impedance increases to 5.4 kΩ. Such a large output impedance causes output signals to easily pick up noise during transmission through a cable, as generally known. The industrial standard of microphones thus defines an output impedance value to be 1 kΩ or less. It is therefore desirable to provide a circuit configuration that can increase the output level while the output impedance is substantially maintained at a normal output level.

To reduce the output impedance, a buffer amplifier circuit including an emitter-follower circuit is connected to the subsequent stage of the step-up transformer. The buffer amplifier circuit, however, requires a power source, and thus a circuit for supplying external power is further necessary to incorporate the buffer amplifier circuit. A known power source connectable to a microphone is a phantom power supply. It is thus demanded to provide a ribbon microphone circuit including an automatic switching system such that, at an increased output level, the buffer amplifier circuit and an external power supply circuit for operation of the buffer amplifier circuit are connected to the ribbon microphone circuit while, at a normal output level, the microphone circuit is operated without connection of the buffer amplifier circuit.

Specifically, it is demanded to provide a ribbon microphone circuit including an automatic switching system such that the microphone outputs signals having a low impedance and a high level while the phantom power supply is being connected, and outputs signals having a high impedance (about 600Ω) and a low level (about −52 dB/Pa) while the phantom power supply is being not connected.

In other words, it is demanded to provide a ribbon microphone circuit including an automatic switching system such that the output impedance can be maintained at a low level by a special circuit at an increased boost ratio of the step-up transformer for an increased output level, and the special circuit can be automatically disconnected at an ordinary output level that is compatible with an output impedance in accordance with the industrial standard. Although there is no existence of related art documents for the purpose of solving the above described problems, Japanese Unexamined Patent Application Publication No. 2007-312260 relating the present application is provided in this specification.

Japanese Unexamined Patent Application Publication No. 2007-312260 discloses a microphone circuit including an amplifier circuit and a power supply circuit for supplying external power, the power supply circuit being automatically switchable to allow a microphone to produce an output even if external power is not supplied. Specifically, the microphone circuit includes an amplifier circuit for amplifying electrical signals output from an electroacoustic transducer module; an external power supply circuit that supplies external power for driving the amplifier circuit; a light that is turned on while the external power is being supplied through the external power supply circuit; and contacts that can be turned on or off depending on the state of the light,. Such components are connected such that the amplifier circuit output signals as a microphone output during a lighting period of the light, while the electroacoustic transducer module outputs signals as a microphone output during a non-lighting period.

SUMMARY OF THE INVENTION

In view of the circumstances above, an object of the present invention is to provide a ribbon microphone circuit including a special circuit for reducing an output impedance, where the special circuit is automatically connected to a power source for a high output level, and the ribbon microphone circuit is automatically switched to a normal circuit configuration for a normal output level.

A ribbon microphone circuit according to the present invention includes a ribbon microphone unit including a ribbon diaphragm disposed in a magnetic gap formed by a magnet fixed to a frame; a step-up transformer boosting signals output from the ribbon microphone unit; buffer amplifier circuits connected to a secondary winding of the step-up transformer; an external power supply circuit supplying external power for driving the buffer amplifier circuits; and a switch circuit including photo-relays having lights that are turned on while the external power is being supplied through the external power supply circuit, and having contacts that are turned on or off in response to states of the respective lights, wherein while the external power is being supplied to the photo-relays from the external power supply circuit, the lights are turned on to supply the external power to the buffer amplifier circuits, and thus signals output from the ribbon microphone unit are extracted from the secondary winding of the step-up transformer through the buffer amplifier circuits, and while the external power is being not supplied to the photo-relays from the external power supply circuit, the lights are turned off to prevent the external power source from being supplied to the buffer amplifier circuits, and thus the signals are extracted from the secondary winding of the step-up transformer without passing through the buffer amplifier circuits.

The present invention provides a ribbon microphone circuit that can output signals having a high level and a low impedance so that the circuit is barely affected by external noise.

DESCRIPTION OF THE PREFERRED EMBODIMENTS

Figure 1:
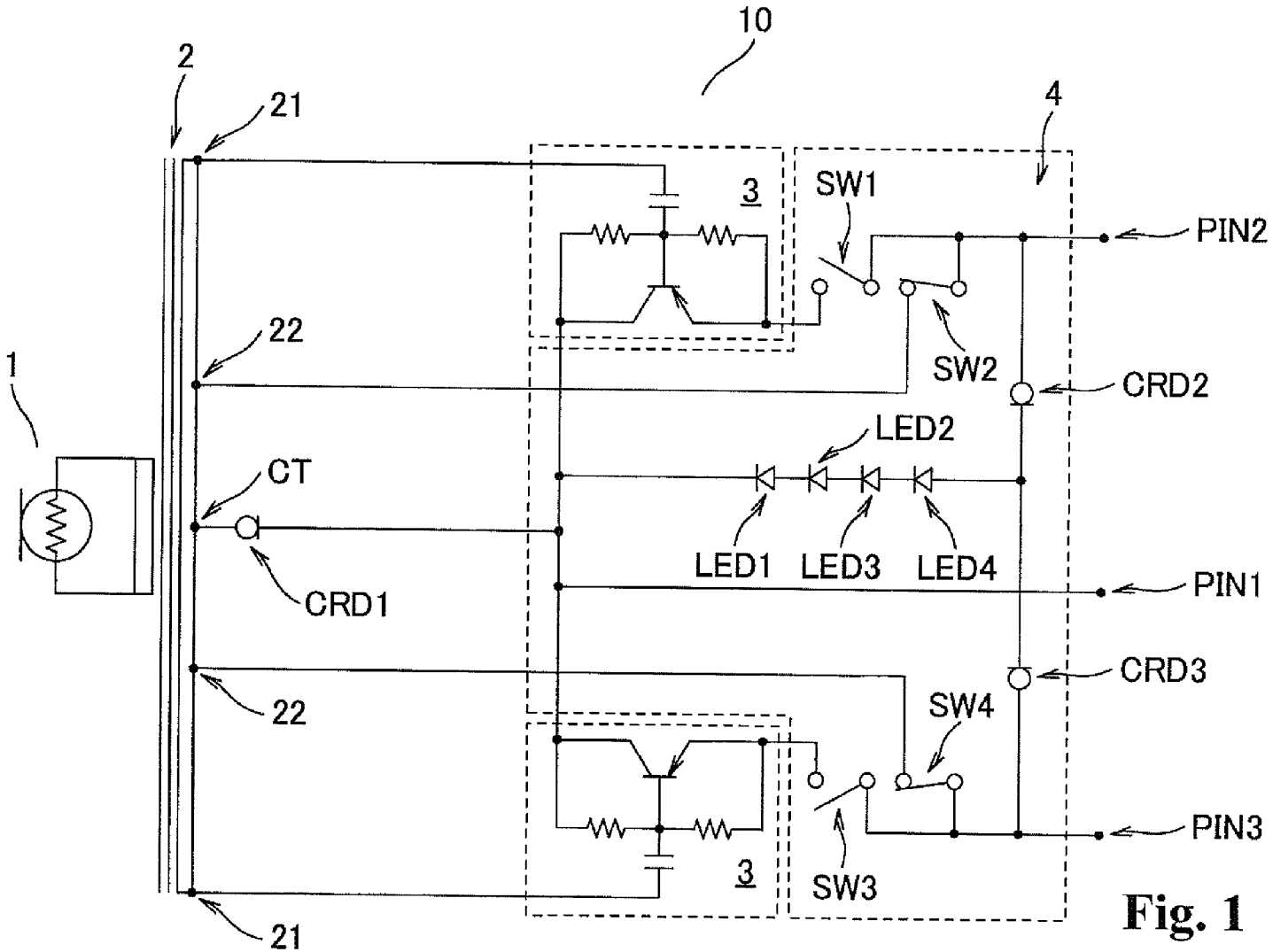
FIG. 1 is a circuit diagram showing an exemplary ribbon microphone circuit according to the present invention.

A ribbon microphone circuit according to an embodiment of the present invention is described below with reference to the attached drawings. FIG. 1 is a circuit diagram showing an exemplary ribbon microphone circuit according to the present invention. FIG. 1 shows a ribbon microphone circuit 10 including a ribbon microphone unit 1, a step-up transformer 2, buffer amplifier circuits 3, and a switch circuit 4.

The ribbon microphone unit 1 includes a ribbon diaphragm that is disposed in a parallel magnetic field and serves also as a conductor. The ribbon diaphragm vibrates in the magnetic field upon receiving sound waves and thus traverses a magnetic flux. An electric current flows through the diaphragm to generate electric signals having a frequency in proportion to the vibration frequency. The signal is output from output terminals provided at longitudinal ends of the ribbon diaphragm. The electric signals are produced through electroacoustic conversion in correspondence to frequency and amplitude of vibration of the ribbon diaphragm, resulting in output of a sound signal corresponding to the sound waves received by the ribbon diaphragm.

The step-up transformer 2 has a primary winding connected to output terminals of the ribbon microphone unit 1, and has a secondary winding having output terminals for outputting electric signals boosted in proportion to the winding ratio (1/N). The secondary winding of the step-up transformer 2 has a central tap CT, and output terminals 21 and output terminals 22, having different winding ratios from each other, are provided on both sides from the central tap CT.

The output terminals 21 are first output terminals provided at both ends of the secondary winding. For example, signals output from the ribbon microphone unit 1 through the output terminals 21 have a level of about −42 dB/Pa and an output impedance of about 5.6 kΩ.

The output terminals 22 are second output terminals provided at positions inside the both ends of the secondary winding. The output terminals 22 are provided at certain positions corresponding to a winding ratio at which the output impedance of the ribbon microphone unit 1 meets the industrial standard. For example, signals output from the ribbon microphone unit 1 through the output terminals 22 has a level of about −52 dB/Pa and an impedance of 600Ω.

The buffer amplifier circuits 3 are provided in correspondence to the output terminals 21 of the step-up transformer 2. Each buffer amplifier circuit 3 is an emitter-follower circuit including a transistor having a base connected to the output terminal 21 and an emitter that acts as an output terminal. The buffer amplifier circuits 3 can reduce the impedance of signals output from the ribbon microphone unit 1 through the output terminals 21.

The switch circuit 4 includes photo-relays including LEDs, or lights, and switches having contacts that are opened or closed (turned on or off) depending on states of the respective LEDs. In FIG. 1, the photo-relays are composed of respective pairs of the LED1 and a switch SW1, the LED2 and a switch SW2, the LED3 and a switch SW3, and the LED4 and a switch SW4.

In the switch circuit 4, the contacts of the switches SW2 and SW4 are normally closed, while the contacts of the switches SW1 and SW3 are normally opened. The LED1 to LED4 are turned on while an external power supply circuit (not shown) is being connected. In addition, constant-current diodes CRD2 and CRD3 are provided for applying a current supplied from the external power supply circuit to the LED1 to LED4.

The constant-current diodes CRD2 and CRD3 each have high AC impedance regardless of a connecting state of the external power supply circuit, and thus do not function as load of sound signals.

The external power supply circuit connected to the ribbon microphone circuit 10 is a phantom power supply circuit. The phantom power supply circuit has HOT and COLD terminals and a ground terminal. In FIG. 1, a terminal PIN1 is to be connected to the ground terminal of the phantom power supply circuit. Terminals PIN2 and PIN3 are to be connected to the HOT and COLD terminals, respectively. Anodes of the constant-current diodes CRD2 and CRD3 are connected to the terminals PIN2 and PIN3, respectively, and both cathodes of the constant-current diodes CRD2 and CRD3 are connected to an anode of the LED4. The LED1 to LED4 are connected in series in order of LED4, LED3, LED2 and LED1 from the cathode of each of the constant-current diodes CRD2 and CRD3, and the cathode of the LED1 is connected to the terminal PIN1, or the ground terminal.

A current sequentially flows to the LED4 to LED 1 through the constant-current diodes CRD2 and CRD3 upon connection of the phantom power supply circuit to the ribbon microphone circuit 10. This results in turn-on of the LEDs.

The switches SW1 to SW4 include photo-MOS relays including active elements, MOS-FETs, so as to open or close respective contacts in response to the turn-on of the LED1 to LED4. The switches SW1 and SW3 have normal-open contacts, and the switches SW2 and SW4 have normal-close contacts.

The switch SW1 is connected between an output terminal of a first buffer amplifier circuit 3 and the terminal PIN2, the switch SW2 is connected between one of the second output terminals 22 of the step-up transformer 2 and the terminal PIN2, the switch SW3 is connected between an output terminal of a second buffer amplifier circuit 3 and the terminal PIN3, and the switch SW4 is connected between the other of the second output terminals 22 and the terminal PIN3.

Accordingly, while the phantom power supply circuit is being not connected, the LED1 to LED4 are not turned on since no current flows to the LEDs, and thus the contacts of the switches SW1 and SW3 are maintained to be opened, while the contacts of the switches SW2 and SW4 are maintained to be closed. Specifically, while the phantom power supply circuit is being not connected, the respective output terminals 22 are connected to the terminals PIN2 and PIN3 through the switches SW2 and SW4, so that the signals are output from the output terminals 22 and then balanced-output to the outside through the terminals PIN2 and PIN3.

That is, the sound signal having low output impedance is output without passing through the buffer amplifiers 3 from the ribbon microphone unit 1.

Figure 2:
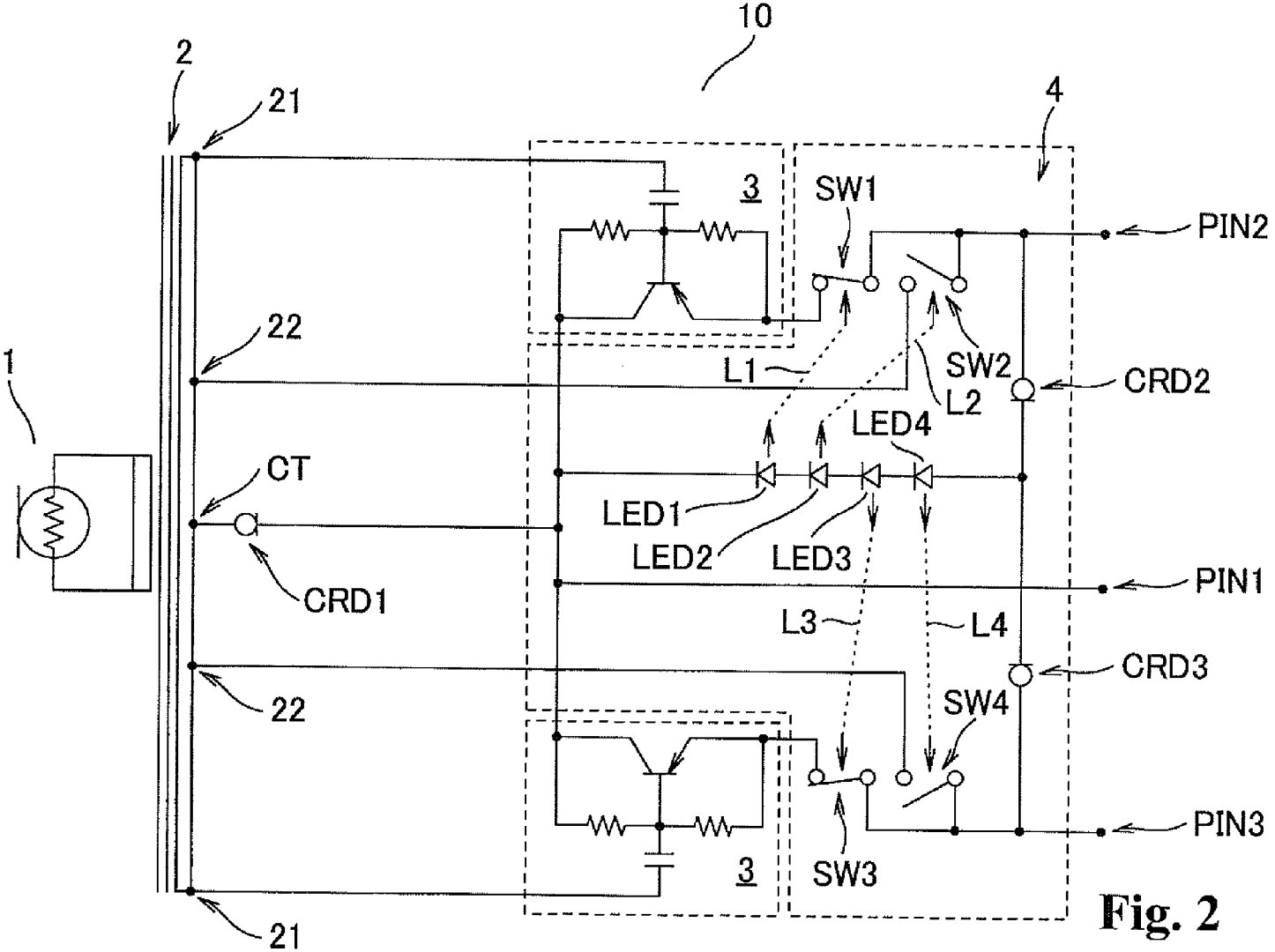
FIG. 2 is a circuit diagram showing a predetermined operation state of the exemplary ribbon microphone circuit.

FIG. 2 shows a state of the ribbon microphone circuit 10 connected with the not-shown phantom power supply circuit, or the external power supply circuit, through the terminals PIN1 to PIN3. The phantom power supply circuit supplies currents through the terminals PIN2 and PIN3, and thus the constant-current diodes CRD2 and CRD3 apply currents to the series circuit of the LED1 to LED4 from the terminals PIN2 and PIN3, respectively. As a result, the LED1 to LED4 are turned on. The LED1 is turned on to emit light L1 for driving the switch SW1. Similarly, the LED2 emits light L2 for driving the switch SW2, the LED3 emits light L3 for driving the switch SW3, and the LED4 emits light L4 for driving the switch SW4.

The LED1 to LED4 are turned on and thus the switches SW1 to SW4 are driven, so that the contacts of the switches SW1 and SW3 are closed, and the contacts of the switches SW2 and SW4 are opened. As a result, each buffer amplifier 3 receives the current supplied from the phantom power supply circuit through each of the terminals PIN2 and PIN3, and thus the buffer amplifier 3 is driven by the current.

The contacts of the switches SW2 and SW4 are opened, and thus the respective output terminals 22 of the step-up transformer 2 are disconnected from the terminals PIN2 and PIN3, so that signals are not output from the ribbon microphone unit 1 through the output terminals 22. Instead, the signals are output from the ribbon microphone unit 1 with a large winding ratio through the output terminals 21 provided at both ends of the secondary winding of the step-up transformer 2.

The respective output terminals 21 are connected to the terminals PIN2 and PIN3 through the buffer amplifiers 3, and thus output impedance of the ribbon microphone unit 1 can be maintained at a low level by the buffer amplifiers 3 despite the large winding ratio, achieving automatic switching to a circuit that can output signals having a high level and a low impedance.

A constant-current diode CRD1 is disposed between the central tap CT of the step-up transformer 2 and the ground terminal PIN1 to prevent a rush current from flowing to the step-up transformer 2 at the timing when the phantom power supply circuit is connected.

As described above, the ribbon microphone circuit according to the invention includes the automatic switching system such that the microphone outputs signals having a normal level and a normal impedance while the phantom power supply circuit is being not connected, and outputs signals having a high level and a low impedance while the phantom power supply circuit is being connected, so that the ribbon microphone circuit is hardly affected by external noise.

What is claimed is:

1. A ribbon microphone circuit comprising:

a ribbon microphone unit including a ribbon diaphragm disposed in a magnetic gap formed by a magnet fixed to a frame;

a step-up transformer boosting signals output from the ribbon microphone unit;

buffer amplifier circuits connected to a secondary winding of the step-up transformer;

an external power supply circuit externally supplying power for driving the buffer amplifier circuits; and a switch circuit including photo-relays having lights that are turned on while the external power source is being supplied through the external power supply circuit, and having contacts that are turned on or off depending on states of the respective lights, wherein while the external power is being supplied to the photo-relays from the external power supply circuit, the lights are turned on to supply the external power source to the buffer amplifier circuits, and signals output from the ribbon microphone unit are sent from the secondary winding of the step-up transformer through the buffer amplifier circuits, and while the external power source is being not supplied to the photo-relays from the external power supply circuit, the lights are turned off to prevent the external power source from being supplied to the buffer amplifier circuits, and the signals are sent from the secondary winding of the step-up transformer without passing through the buffer amplifier circuits.

2. The ribbon microphone circuit according to claim 1, wherein the step-up transformer has first output terminals at both ends of the secondary winding, and has second output terminals at respective positions inside the two ends of the secondary winding, and the respective buffer amplifier circuits are connected to the first output terminals.

3. The ribbon microphone circuit according to claim 1, wherein the photo-relays of the switch circuit include first photo-relays each having a contact that is opened in response to supply of the power source from the external power supply circuit, and second photo-relays each having a contact that is closed in response to supply of the power source from the external power supply circuit, wherein the respective first photo-relays and the respective second photo-relays are connected into pairs, and the respective first photo-relays are connected to the buffer amplifier circuits, and the respective second photo-relays are connected to the second output terminals.

4. The ribbon microphone circuit according to claim 1, wherein the external power source is a phantom power source, and the external power supply circuit includes a 3-line microphone cable including a ground line, a HOT signal line, and a COLD signal line, and includes a 3-pin connector for coupling with the microphone cable.

5. The ribbon microphone circuit according to claim 2, wherein the secondary winding of the step-up transformer has a central tap, and the first output terminals and the second output terminals are provided on both sides from the central tap, and the buffer amplifier circuits are provided in correspondence to the first output terminals, and the switch circuit is provided in correspondence to the second output terminals, and thus a sound signal generated through electroacoustic conversion in the ribbon microphone unit is balanced-output.

6. The ribbon microphone circuit according to claim 5, wherein a constant current diode is connected between the central tap of the step-up transformer and ground.

7. The ribbon microphone circuit according to claim 1, wherein the photo-relays include photo-MOS relays each including LED as the light and MOS-FET as the contact that is turned on or off depending on a state of the light.

* * * * *